US006016831A

United States Patent [19]

Bueser et al.

[11] Patent Number: 6,016,831

[45] Date of Patent: Jan. 25, 2000

[54] PRESSURE REGULATOR FOR A FUEL SYSTEM

[75] Inventors: Wolfgang Bueser, Freiberg; Dietmar Schmieder, Markgroeningen; Willi Strohl, Beilstein; Dieter Issler, Leonberg; Jochen Rose, Hemmingen; Alexander Brand, Germering; Rudolf Meidinger, Falhenstein; Erich Eiler, Sersheim, all of Germany; Frantisek Buric; Jaroslay Moucka, both of Ceske Budejovice, Czech Rep.

[73] Assignee: Robert Bosch GmbH, Stuttgart

[21] Appl. No.: 09/171,130

[22] PCT Filed: Dec. 9, 1997

[86] PCT No.: PCT/DE97/02862

§ 371 Date: Mar. 31, 1999

§ 102(e) Date: Mar. 31, 1999

[87] PCT Pub. No.: WO98/36168

PCT Pub. Date: Aug. 20, 1998

[30] Foreign Application Priority Data

Feb. 13, 1997 [DE] Germany ..... 197 05 405

[51] Int. Cl.[7] ..... F02M 37/10; F02M 69/54

[52] U.S. Cl. ..... 137/315; 123/457; 137/510

[58] Field of Search ..... 137/315, 510; 123/457, 463

[56] References Cited

U.S. PATENT DOCUMENTS

| | | | |
|---|---|---|---|
| 5,078,167 | 1/1992 | Brandt et al. | 137/510 |
| 5,458,104 | 10/1995 | Tuckey | 137/510 |
| 5,577,478 | 11/1996 | Tuckey | 123/457 |
| 5,720,263 | 2/1998 | Frank et al. | 137/510 |

FOREIGN PATENT DOCUMENTS

| | | |
|---|---|---|
| 166528 | 1/1986 | European Pat. Off. . |
| 1213149 | 11/1970 | United Kingdom . |

*Primary Examiner*—Stephen M. Hepperle
*Attorney, Agent, or Firm*—Edwin E. Greigg; Ronald E. Geigg

[57] ABSTRACT

The invention relates to a pressure regulator for a fuel system. The pressure regulator includes a housing assembled out of at least two housing parts. A membrane unit is securely installed in a sealed fashion between the housing parts. The securing region that securely holds the two housing parts and the membrane unit in a sealed fashion has an elastic region so that the desired secure connection is assured by simply snapping the two housing parts together. The device is provided in particular for regulating a pressure in a fuel system.

20 Claims, 5 Drawing Sheets

PRESSURE REGULATOR FOR A FUEL SYSTEM

PRIOR ART

The invention is based on a pressure regulator for a fuel systems.

There is a large number of publications that disclose a pressure regulator whose housing is comprised of two housing parts connected by means of a crimped edge, wherein a membrane unit that divides two chambers from each other in the housing is also clamped at the crimped edge. The German published patent application 23 54 461 will be used as a representative for the many publications.

Because there is fuel in the housing, it is very important that the connection that clamps the two housing parts together and secures the membrane unit is sealed, particularly if the device is disposed outside a fuel tank, for example in the vicinity of a hot internal combustion engine.

Because leaks can occur even with carefully created crimped edges, e.g. after damage due to shocks to the housing, it has already been proposed that the two housing parts be welded together over their entire circumference. This process, however, is very costly and despite cooling measures, the membrane unit cannot be prevented from being damaged by heat generated during the welding process.

For the crimping of the two housing parts, high forces must be used for shaping the edges of the housing parts. In particular, attention must be paid that during crimping, the regions of the housing disposed outside the crimp are not unduly deformed. Since high forces are required for the crimping, the fact that the housing is not unduly deformed during the crimping must be assured with costly measures, in particular by means of careful securing of the housing parts in special machines. It is therefore also not advisable to entirely or partially cast or mold the housing in plastic because then the forces acting on the housing during the crimping can no longer be reliably intercepted.

An extremely high degree of care must be exercised when crimping the housing parts. In particular, the limits of the permissible tolerances of the material used for the housing parts, the material used for the membrane, the dimensions of the housing parts, the dimensions of the membrane, the forces exerted during the crimping, the die forms used for the crimping, to name only a few examples, must be very narrowly set, which leads to high costs for the manufacture. Even the slightest overstepping of the narrow tolerance limits can lead to a malfunction, in particular to a leak. Also, sags that appear during the use of the device can lead to a malfunction, in particular to a leak. Because an inadequate crimping of the housing parts sometimes only leads to a leak after a long service life of the device, there is a great danger that occasionally, a large number of inadequately crimped housings reaches the customer before the defect is detected. Also, sags that appear between the housing parts to be crimped and the membrane unit during the operation of the device can occasionally lead to leaks even if in a first testing of the crimp, it appeared as though the crimp was in order.

ADVANTAGES OF THE INVENTION

The device for a fuel system, according to the invention has the advantage over the prior art that the housing parts can be assembled without a high cost and by using relatively low forces that are easy to produce.

Another advantage is that the limits of the tolerances in the materials of the housing parts and the membrane unit can be far apart from each other without having to fear that the device will be leaky.

Because the assembly of the housing parts can occur very simply, in particular without expensive devices and machines, the assembly of the device can advantageously be established at any desirable location on a production line.

Because only low forces are required to assemble the housing parts, it is possible to cast the housing of the device, for example in plastic, without having to fear that damage can occur when assembling the housing parts.

Also, deformations of the housing, which can occur, for example, when something strikes against the finished housing, advantageously hardly ever lead to a leak.

Advantageous improvements and updates of the device for a fuel system are possible by means of the measures taken in the assembly.

If one of the housing parts is embodied so that it is U-shaped when the cross section of the housing part is considered in the securing region, then this has the advantage that even with relatively thin wall thicknesses of the housing, a high stability of the housing can be achieved.

BRIEF DESCRIPTION OF THE DRAWINGS

Preferably selected, particularly advantageous exemplary embodiments of the invention are shown in simplified form in the drawings and will be explained in more detail in the subsequent description. In different scales.

DESCRIPTION OF THE EXEMPLARY EMBODIMENTS

The device that is embodied according to the invention and is for a fuel system, in particular of an internal combustion engine, has a housing comprised of a number of, housing parts preferably two of them. In the housing, there is a membrane or membrane unit which divides two chambers from each other. The membrane or membrane unit is secured and sealed on its outer circumference. For reasons of simplicity, the securing and sealing of the membrane or membrane unit occurs at the location in which two of the at least two housing parts of the housing are assembled.

Figure 1:
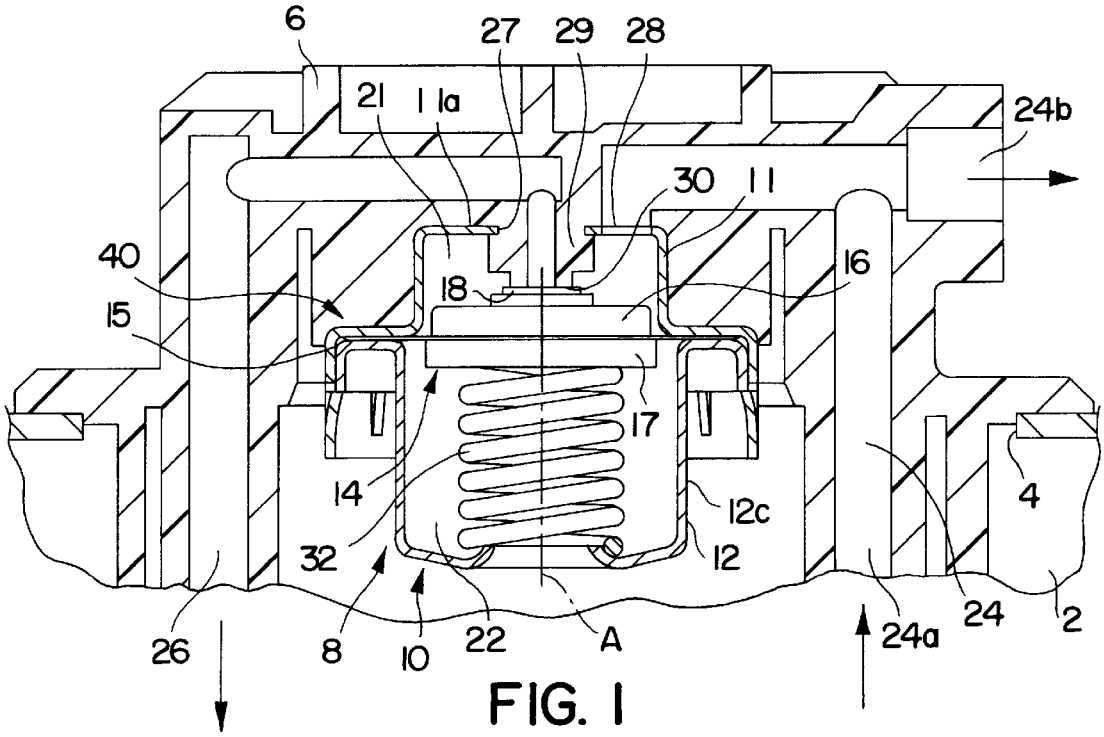
FIGS. 1 to 7 show different cross sectional views of exemplary embodiments and details of differently embodied devices for a fuel system.

FIG. 1 shows a preferably selected, particularly advantageous first exemplary embodiment.

In a sectional view, FIG. 1 shows an upper partial region of a fuel tank 2. The fuel tank 2 has an opening 4 in its upper wall. The opening 4 is closed with a cover comprised of plastic. For the sake of simplicity, the cover will be called the base body 6 below. The cover or base body 6 is secured to the upper wall of the fuel tank 2 with the aid of screws that are not shown. In order to be able to manufacture the base body 6 for a justifiable cost despite its not exactly simple shape, and for weight reasons, the base body 6 is comprised of plastic. A pressure regulator 8 is integrated in terms of function and shape securely into the base body 6. The pressure regulator 8 has a housing 10. In the exemplary embodiment depicted, the housing 10 is comprised of a first housing part 11 and a second housing part 12. Although in the selected exemplary embodiment, the first housing part 11 is aligned toward the top, the first housing part 11 is frequently called the bottom part and the second housing part 12 is frequently called the top part. The housing 10 is essentially rotationally symmetrical. An imaginary rotational axis of the housing 10 is called the longitudinal axis A and is indicated in the drawing with a dot-and-dash line. There is a membrane unit 14 in the housing 10. In the exemplary embodiment depicted, the membrane unit 14 includes a membrane 15, a first plate 16, a second plate 17, and a closing body 18. The plates 16 and 17 are connected to the membrane 15 in the central region of the membrane 15. On its outer circumference, the membrane 15 is inserted between the first housing part 11 and the second housing part 12. The first plate 16 holds the closing body 18, which is a flattened ball, for example. The membrane 15 is comprised of one or a number of layers of flexible plastic sheet, preferably two of them. A cloth layer can be disposed between the plastic sheets. In particularly supported cases, if so desired, the plates 16, 17 attached to the membrane 15 and to the closing body 18 can be eliminated so that only the membrane 15, without the parts 16, 17, 18, is inserted between the housing parts 11, 12.

The membrane 15 of the membrane unit 14 divides a first chamber 21 from a second chamber 22. The first chamber 21 is disposed essentially inside the first housing part 11 and the second chamber 22 is disposed essentially inside the second housing part 12. Inside the base body 6, there is a supply conduit 24 and a return conduit 26. In the exemplary embodiment depicted, the supply conduit 24 has an inlet end 24*a* and a continuing end 24*b*. On its end face, the first housing part 11 has a bottom region 11*a* with a central recess 27. Laterally offset, the bottom region 11*a* has an opening 28. A fitting 29 that protrudes through the central recess 27 is formed onto the base body 6. A stop 30 is provided on an end face of the fitting 29 oriented toward the closing body 18 of the membrane unit 14. The return conduit 26 passes through the base body 6 until the stop 30 provided on the end face of the fitting 29 oriented toward the closing body 18. In the selected exemplary embodiment, the stop 30 provided on the base body 6 is used as a valve seat for the closing body 18.

The inlet end 24*a* of the supply conduit 24 is connected to a fuel pump that is provided in the fuel tank 2 and is not shown for the sake of better visibility. Fuel supplied by the fuel pump travels through the inlet end 24*a* and from there, through the supply conduit 24 to the continuing end 24*b* and then, for example, to the injection valves, not shown. By means of the supply conduit 24, the fuel also travels through the opening 28 into the first chamber 21. If the pressure in the first chamber 21 is lower than a designated opening pressure, then the closing body 18 rests against the stop 30 and the first chamber 21 is closed off in relation to the return conduit 26. If the pressure in the first chamber 21 exceeds the designated opening pressure, then the closing body 18 of the membrane unit 14 lifts up from the stop 30 and excess fuel can travel out of the supply conduit 24, through the first chamber 21, through the gap between the stop 30 and the closing body 18, and then through the return conduit 26 back into the fuel tank 2. A closing force acts on the plate 17 and therefore the closing body 18 in the direction of the stop 30. In the exemplary embodiment depicted, the closing force is generated by a closing spring 32. In lieu of the closing spring 32 or in addition to the closing spring 32, a pressure prevailing in the second chamber 22 can be used to generate the closing force.

The device depicted in FIG. 1 has a securing region 40 on the housing 10. For the sake of better visibility, the part of the device where the securing region 40 is located is reproduced again in FIGS. 2*a* and 2*b* with an altered scale, and in FIG. 3, the first housing part 11 is reproduced separately, leaving out all other parts.

In all of the Figs., the same parts or parts that function equivalently are provided with the same reference numerals. If nothing to the contrary is mentioned or depicted in the drawings, that which is mentioned and depicted in conjunction with one of the Figs. also applies to the other exemplary embodiments. Provided that the explanations do not state otherwise, the details of the different exemplary embodiments can be combined with one another.

Figure 2A:
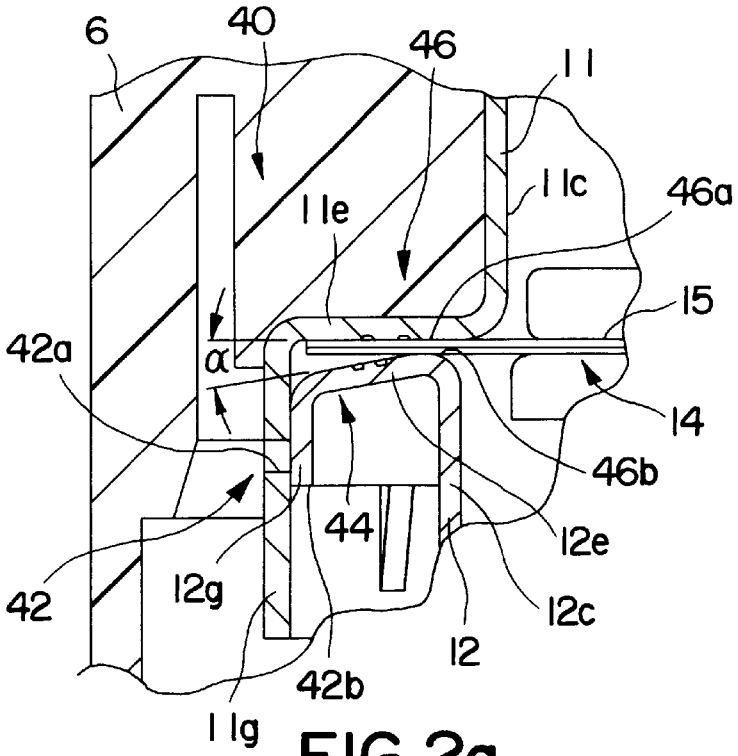
Figure 2B:
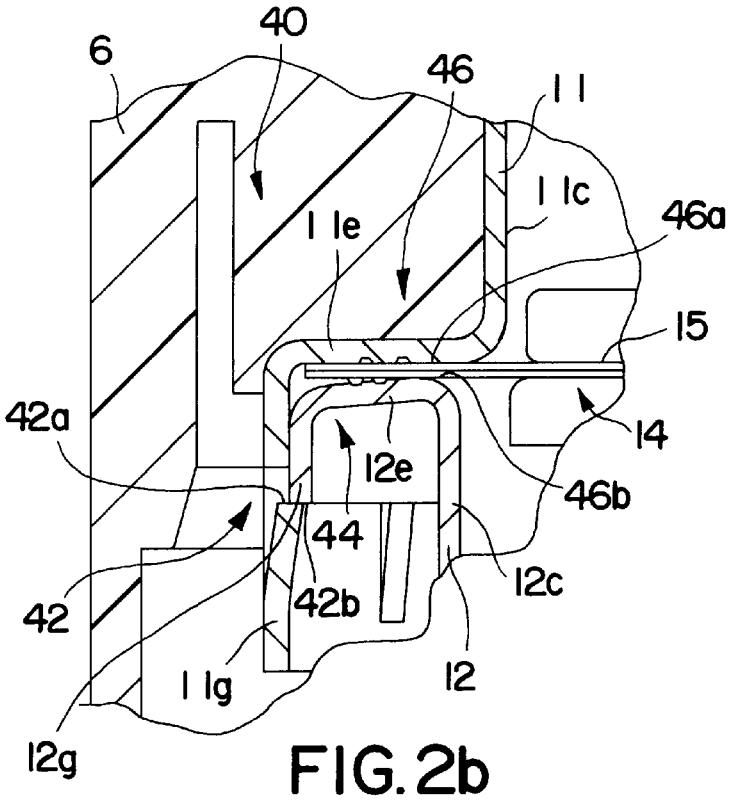

In the securing region 40 of the device or the housing 10 in turn, there are a number of bottom regions. The bottom regions of the securing region 40 include a detent region 42, an elastic region 44, and a clamping region 46. FIG. 2A shows the device before the two housing parts 11, 12 are connected to each other in detent fashion in the securing region 40. FIG. 2B shows the two housing parts 11, 12 after the two housing parts 11, 12 are connected to each other in detent fashion in the detent region 42 of the securing region 40.

Next to the bottom region 11*a* with the central recess 27 (FIG. 3), the first housing part 11 has a cylindrical region 11*c*, and next to that, a region 11*e* that extends radially, crosswise to the longitudinal axis A of the housing 10 and is adjoined by another region 11*g* extending in the shape of a cylinder. The second housing part 12 has a cylindrical region 12*c* and next to that, an essentially radially extending region 12*e*, and adjoining this, a region 12*g* that extends essentially in the shape of a cylinder. The region 12*e* is slightly inclined conically and constitutes a continuous face like the jacket face of a truncated cone. The region 12*g* constitutes a continuous outer collar of the housing part 12.

The clamping region 46 (FIGS. 2*a*, 2*b*) is essentially constituted by a clamping point 46*a* on the housing part 11 and a clamping point 46*b* on the housing part 12. The clamping point 46*a* is provided on the radially extending region 11*e* on the end oriented toward the region 12*e*. The clamping point 46*b* is disposed in the region 12*e*, on the end oriented toward the radially extending region 11*e*.

Figure 3:
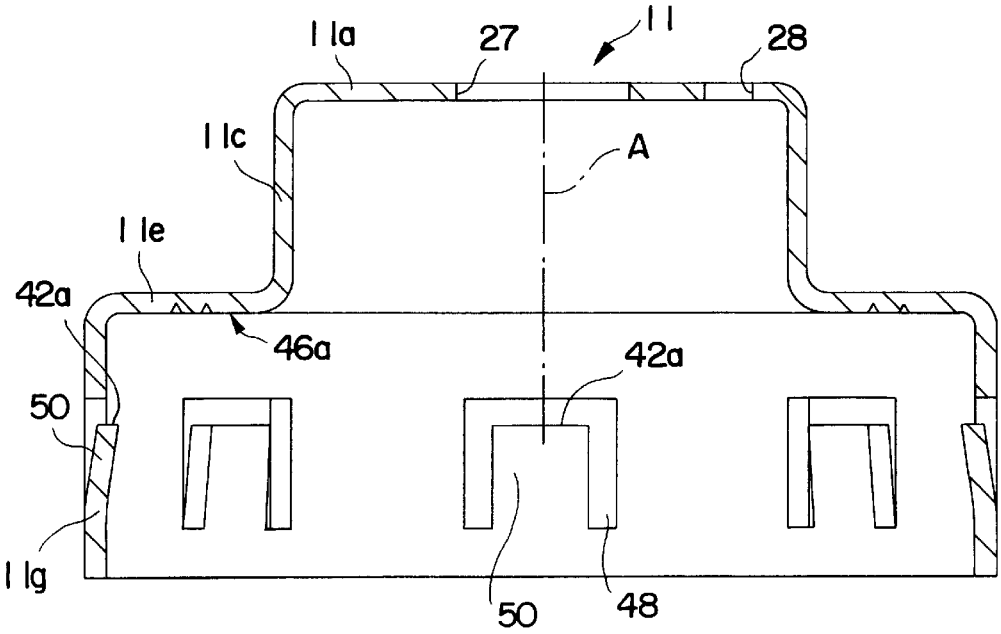

In the cylindrically extending region 11*g* of the first housing part 11, there are a number of U-shaped cut-outs 48 distributed continuously and evenly over the circumference (FIG. 3). By means of the cut-outs 48, a number of tabs 50 are formed on the housing part 11 that radially protrude slightly inward. When FIG. 3 is considered, it is clear that each of the tabs 50 has an end face that radially protrudes slightly inward and is oriented toward the bottom region 11*a*. This end face of the tab 50 constitutes a detent point 42*a* that is provided on the first housing part 11 and belongs to the detent region 42. Viewed in terms of cross section, the second housing part 12 is U-shaped in the securing region 40. When FIGS. 2*a* and 2*b* are considered, the U-shaped form of the second housing part 12 is visible in the securing region 40, wherein the cylindrical region 12*c* constitutes an inner leg, the cylindrically extending region 12*g* constitutes an outer leg, and the region 12*e* constitutes a connecting section of the two legs of the housing part 12. The cylindrically extending region 12*g* of the housing part 12 has a circumferential end face that is remote from the region 12*e* and constitutes the detent point 42*b* belonging to the detent region 42 (FIGS. 2*a*, 2*b*).

The housing parts 11, 12 are assembled by virtue of the fact that they are oriented flush and then slid together. The longitudinal axis A is also the direction for the assembly.

Before the assembly, the membrane unit 14 is placed against the radially extending region 11*e* of the housing part 11. To that end, the device can be rotated by 180° in relation to the position shown. Then, the housing part 12 is inserted into the region 11*g* of the housing part 11. As FIG. 2*a* shows, the region 11*e* of the first housing part 11 and the region 12*e* of the second housing part 12 do not run parallel to each other, but are inclined in relation to each other at an angle α (alpha). At the place where the region 12*e* transitions into the cylindrical region 12*c,* the region 12*e* has a continuous region that protrudes the farthest in the direction of the first housing part 11. If the two housing parts 11 and 12 are assembled by being slid toward each other in the direction of the longitudinal axis A, then this protruding, continuous region of the region 12*e* is the first to circumferentially touch the membrane 15, which is resting over the entire width against the essentially radially extending region 11*e* of the first housing part 11. The second housing part 12, with the protruding, continuous region of the region 12*e,* presses the membrane 15 against the first housing part 11 before the two detent points 42*a,* 42*b* of the detent region 42 reach engagement with each other. In order to bring the two detent points 42*a,* 42*b* into engagement with each other, the region 12*g* of the second housing part 12 must be pressed with easy-to-exert force in the direction of the longitudinal axis A against the first housing part 11. The angle α (alpha) is thereby reduced, wherein the elastic region 44 provided between the clamping region 46 and the detent region 42 is elastically deformed. The angle α (alpha) is reduced until it is zero or close to zero, depending on the tolerance situation of the components to be assembled with each other. The elastic region 44 provided on the housing 10 assures that the membrane 15 is clamped securely and in a sealed fashion between the clamping point 46*a* on the first housing part 11 and the clamping point 46*b* on the second housing part 12 and remains so. The membrane 15 remains securely clamped in a sealed fashion even if any appearances of sagging occur with longer operation of the device. If any appearances of sagging should occur, then the angle α (alpha) may possibly increase. As a result of the elastic initial stress in the elastic region 44, though, sufficient initial stress always remains to securely hold the membrane 15 in a sealed fashion between the two housing parts 11 and 12. It should be further emphasized that in the manufacture of the housing parts 11, 12, no particularly narrow dimensional tolerances have to be maintained in the securing region 40 since the elastic region 44 is sufficiently elastic so that under any circumstances, even when there is a great dimensional tolerance, sufficient initial stress is present and remains to secure the membrane 15. Moreover, it should be further emphasized that the material properties of the housing parts 11, 12 can also lie within a coarsely tolerable scope without having to fear an insufficient clamping of the membrane 15. Since relatively low forces are sufficient for the assembly of the two housing parts 11, 12 and no complicated shaping procedures are necessary, the assembly process for putting together the two housing parts 11, 12 can occur independently from complicated machines during the manufacture process of the device.

The detent point 42*a* at the tab 50 of the first housing part 11 radially protrudes slightly inward (FIG. 3). During the assembly of the two housing parts 11, 12, if the cylindrically extending region 12*g* of the second housing part 12 arrives in the region of the tabs 50, then the detent points 42*a* on the first housing part 11 are pressed elastically outward radially (FIG. 2*a*). During the assembly, the second housing part 12 is pressed in the direction of the longitudinal axis A against the first housing part 11. As a result, the elastic region 44 is elastically deformed until the detent point 42*a* at the tab 50 snaps radially in again over the detent point 42*b* on the second housing part 12. As a result, the detent point 42*a* on the first housing part 11 engages in detent fashion with the detent point 42*b* on the second housing part 12, by means of which the two housing parts 11, 12 are reliably and securely held together. The elastic region 44 presses the detent point 42*b* against the detent point 42*a* so that the connection between the two housing parts 11, 12 is reliable and free of play.

Figure 4A:
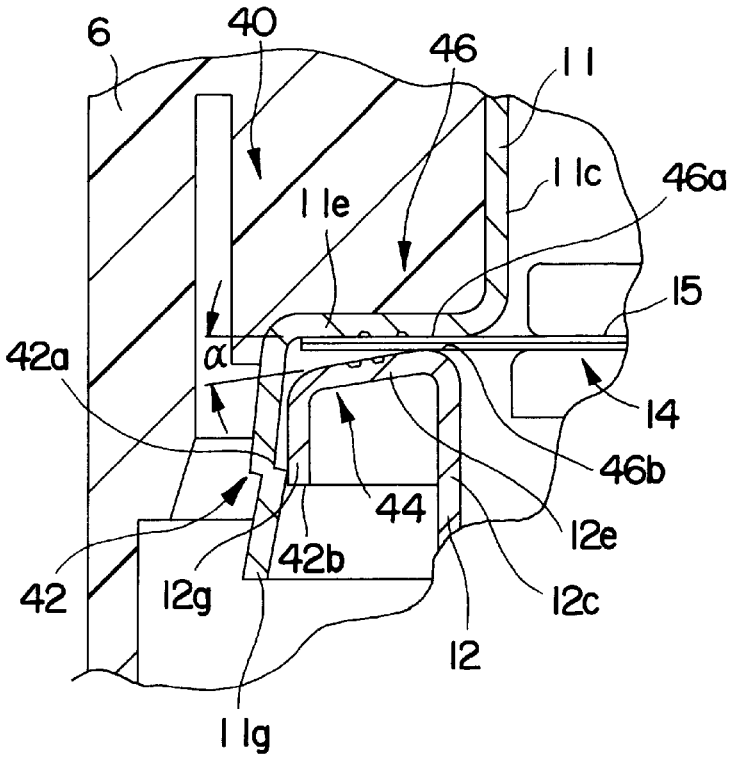
Figure 4B:
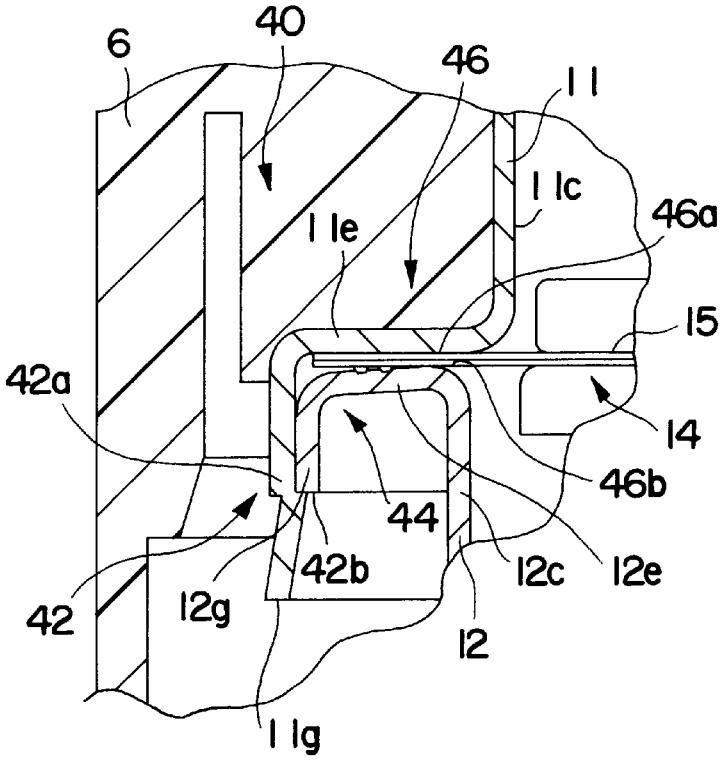
Figure 5:
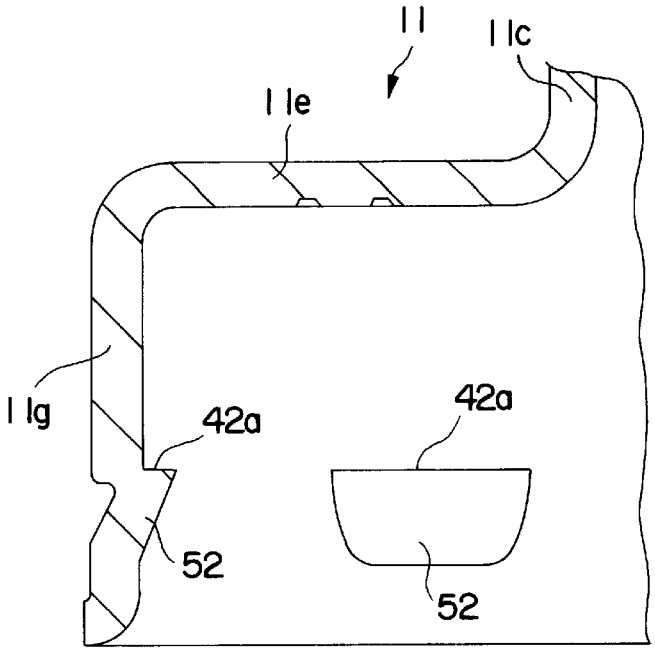

FIGS. 4*a,* 4*b,* and 5 show details of another selected, particularly advantageous exemplary embodiment. FIG. 4*a* shows the securing region 40 before the two housing parts 11, 12 are connected to each other in detent fashion, and FIG. 4*b* shows the securing region 40 after the detent connection of the two housing parts 11, 12. FIG. 5 shows a detail of the first housing part 11, with the remaining components of the device left out.

As shown in FIG. 5, a number of undercuts 52, which protrude radially inward, are evenly distributed over the circumference, and are provided at the same location in terms of the axial direction, are molded onto the region 11*g* of the first housing part 11. The end of the undercut 52 oriented toward the region 11*e* is embodied as relatively sharp-edged, and the detent point 42*a* is disposed on the side of the undercut 52 oriented toward the region 11*e.* The undercuts 52 (FIG. 5) are less elastic than the tabs 50 (FIG. 3). As a result, in the exemplary embodiment according to FIG. 5, when the second housing part 12 is pressed into the first housing part 11, the region 11*g* of the first housing part 11 and the region 12*g* of the second housing part 12 are elastically deformed in the radial direction until the detent point 42*b* of the second housing part 12 snaps over the detent point 42*a* on the first housing part 11. Depending on the material thickness chosen, the region 11*g* and/or the region 12*g* are slightly out of round during the insertion process. After the end of the insertion process, the regions 11*g,* 12*g* return elastically to their round shape. In contrast to the exemplary embodiment with the U-shaped cut-outs 48 (FIG. 3), in the exemplary embodiment shown in FIGS. 4*a,* 4*b,* and 5, a somewhat higher degree of rigidity can be achieved with the same material thickness and the missing cut-outs offer advantages in the casting or molding of the base body 6 onto the first housing part 11 because then, no plastic material can flow through the cut-outs.

Figure 6:
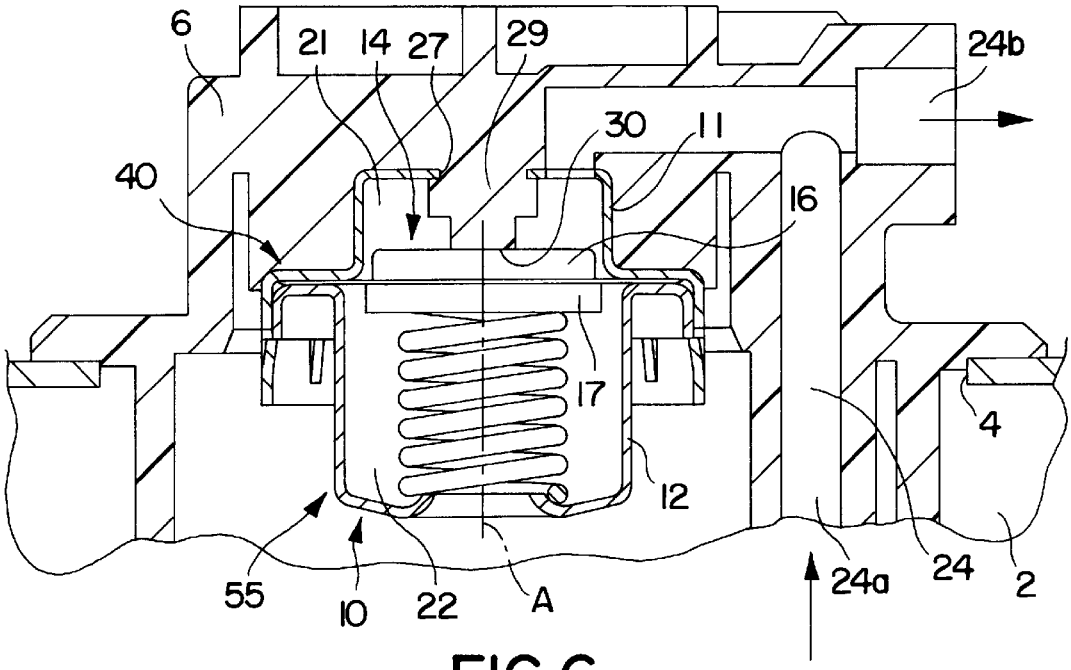

FIG. 6 shows another preferably selected, advantageous exemplary embodiment.

In the exemplary embodiment shown in FIG. 1, the device with the base body 6, the housing 10, the membrane unit 14 incorporated into the housing 10, and the stop 30 on the base body 6 constitutes the pressure regulator 8. In the exemplary embodiment shown in FIG. 6, the base body 6, the housing 10, the membrane unit 14, and the stop 30 are the essential parts of a reservoir 55. Depending on whether the reservoir 55 takes in or gives out a relatively large amount or a relatively small amount of fuel when there are pressure changes in the supply conduit 24, the reservoir 55 is used only to smooth sharp pressure pulsations in the supply conduit 24, or when there is a pressure increase, the reservoir 55 can receive greater quantities of fuel which it then gives out again when the pressure decreases so that the reservoir 55 can effectively function as a fuel reservoir.

With the pressure regulator 8 (FIG. 1) and with the reservoir 55 (FIG. 6), the base body 6, which is comprised of relatively soft material, preferably plastic, is molded or cast onto the first housing part 11. The pressure regulator 8 or the reservoir 55 can consequently be integrated in a simple manner into a plastic body. In order to permit a favorable cohesion between the housing part 11 and the base body 6, the diameter of the recess 27 is smaller than the diameter of the fitting 29. The base body 6 is, for example, a cover for closing the fuel tank 2, or the base body 6 is, for example, a fuel distributing tube that is incorporated into an engine compartment of a vehicle and a number of lines branch from this tube, leading to injection valves.

Figure 7:
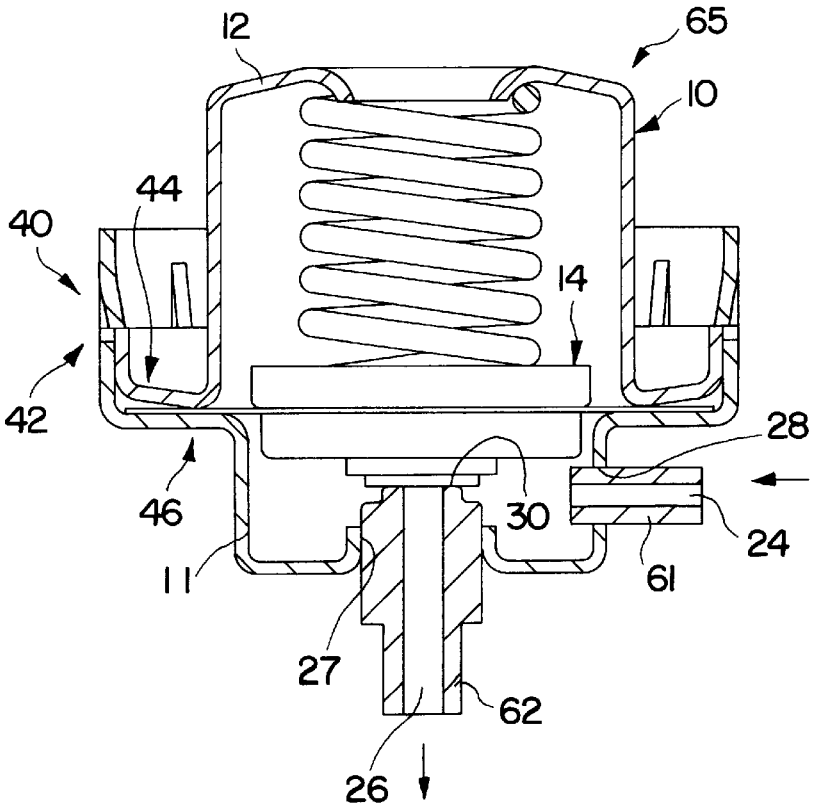

FIG. 7 shows another preferably selected, particularly advantageous exemplary embodiment.

In this exemplary embodiment, a first fitting 61 is soldered, welded, or crimped in a known manner into the first housing part 11, i.e. in the laterally provided opening 28, and a second fitting 62 is fastened in the same way into the recess 27. In the exemplary embodiment shown in FIG. 7, the supply conduit 24 extends through the first fitting 61 and the return conduit 26 extends through the second fitting 62. The device constitutes a pressure regulator 65 for installation in a hose line. The pressure regulator 65 (FIG. 7) is installed in a line. For example, a hose is connected to each of the fittings 61 and 62.

Also with the reservoir 55 (FIG. 6) and with the pressure regulator 65 (FIG. 7), the securing region 40 can be embodied in the way that is shown in FIGS. 1, 2*a*, 2*b*, 3, 4*a*, 4*b*, 5, and explained in the description in conjunction with these Figs. In all cases, with the device embodied according to the invention, the advantage is obtained that the two housing parts 11, 12 can be assembled using relatively low forces and the membrane unit 14 or the membrane 15 is securely held in a sealed fashion between the two housing parts 11, 12, even with a longer operating time.

Due to the low force required for assembly, damage need not be feared, particularly damage to the base body 6 (FIGS. 1, 6) and the membrane 15.

In the exemplary embodiments shown, the first housing part 11 has an approximately Z-shaped form in the securing region 40 and the second housing part 12 has an approximately U-shaped form. It should be further noted that in lieu of this, the first housing part 11 in the securing region 40 can also be embodied as U-shaped and the second housing part 12 can be correspondingly embodied as Z-shaped. The elastic region 44 is produced in the examples shown by means of elastic deformation of the second housing part 12. However, the elastic region can also be produced by the elastic deformation of the first housing part 11, preferably the region 11*e*. It is also possible to elastically deform both housing parts 11 and 12 between the detent region 42 and the clamping region 46 in order to thus obtain the elastic region 44. The foregoing relates to a preferred exemplary embodiment of the invention, it being understood that other variants and embodiments thereof are possible within the spirit and scope of the invention, the latter being defined by the appended claims.

We claim:

1. A device for a fuel system, comprising a housing (10) comprised of a first housing part (11) and at least one second housing part (12), wherein the two housing parts (11, 12) are held together in a securing region (40), a membrane unit (14, 15) that divides a first chamber from a second chamber is clamped in the securing region (40) between the first housing part (11) and the second housing part (12), the securing region (40) includes a detent region (42) with at least one first detent point (42*a*) provided on the first housing part (11) and with at least one second detent point (42*b*) that is provided on the second housing part (12) and engages in detent fashion with the first detent point (42*a*), a clamping region (46) with at least one clamping point (46*a*) provided on the first housing part (11) and having at least one second clamping point (46*b*) provided on the second housing part (12), wherein between the detent region (42) and the clamping region (46), at least one elastic region (44) is provided and the membrane unit (14, 15) is clamped in the clamping region (46) by means of an elastic initial stress that is produced by an elastic deformation of the elastic region (44).

2. The device for a fuel system according to claim 1, in which for a detent connection of the two detent points (42*a*, 42*b*) of the two housing parts (11, 12), the two housing parts (11, 12) are acted on toward each other in an assembly direction (A) with an assembly force and the elastic deformation of the elastic region (44) is produced by the assembly force.

3. The device for a fuel system according to claim 1, in which the elastic region (44) is constituted by a first face (11*e*) that adjoins the first clamping point (46*a*) and a second face (12*e*) that adjoins the second clamping point (46*b*), wherein the two faces (11*e*, 12*e*) extend at an angle (α (alpha)) in relation to each other.

4. The device for a fuel system according to claim 2, in which the elastic region (44) is constituted by a first face (11*e*) that adjoins the first clamping point (46*a*) and a second face (12*e*) that adjoins the second clamping point (46*b*), wherein the two faces (11*e*, 12*e*) extend at an angle (α (alpha)) in relation to each other.

5. The device for a fuel system according to claim 3, in which the angle (α (alpha)) opens in a direction of the detent region (42).

6. The device for a fuel system according to claim 4, in which the angle (α (alpha)) opens in a direction of the detent region (42).

7. The device for a fuel system according to claim 3, in which the elastic initial stress in an assembly of the first housing part (11) with the second housing part (12) is produced by a change of the angle (α (alpha)).

8. The device for a fuel system according to claim 4, in which the elastic initial stress in an assembly of the first housing part (11) with the second housing part (12) is produced by a change of the angle (α (alpha)).

9. The device for a fuel system according to claim 1, in which one of the housing parts (12) is cross sectionally embodied as U-shaped in the securing region (40) and has two legs (12*c*, 12*g*) and a connecting section (12*e*), wherein the detent region (42) is provided on one of the two legs (12*g*) and the clamping region (46) is provided on the connecting section (12*e*).

10. The device for a fuel system according to claim 2, in which one of the housing parts (12) is cross sectionally embodied as U-shaped in the securing region (40) and has two legs (12*c*, 12*g*) and a connecting section (12*e*), wherein the detent region (42) is provided on one of the two legs (12*g*) and the clamping region (46) is provided on the connecting section (12*e*).

11. The device for a fuel system according to claim 3, in which one of the housing parts (12) is cross sectionally embodied as U-shaped in the securing region (40) and has two legs (12*c*, 12*g*) and a connecting section (12*e*), wherein the detent region (42) is provided on one of the two legs (12*g*) and the clamping region (46) is provided on the connecting section (12*e*).

12. The device for a fuel system according to claim 5, in which one of the housing parts (12) is cross sectionally embodied as U-shaped in the securing region (40) and has two legs (12*c*, 12*g*) and a connecting section (12*e*), wherein the detent region (42) is provided on one of the two legs (12*g*) and the clamping region (46) is provided on the connecting section (12*e*).

13. The device for a fuel system according to claim 7, in which one of the housing parts (12) is cross sectionally embodied as U-shaped in the securing region (40) and has two legs (12*c,* 12*g*) and a connecting section (12*e*), wherein the detent region (42) is provided on one of the two legs (12*g*) and the clamping region (46) is provided on the connecting section (12*e*).

14. The device for a fuel system according to claim 9, in which at least one radially directed projection (50, 52) is provided on the respective other housing part (11) and engages behind one of the legs (12*g*).

15. The device for a fuel system according to claim 1, in which one of the housing parts (11) is molded into a plastic part (6).

16. The device for a fuel system according to claim 2, in which one of the housing parts (11) is molded into a plastic part (6).

17. The device for a fuel system according to claim 3, in which one of the housing parts (11) is molded into a plastic part (6).

18. The device for a fuel system according to claim 5, in which one of the housing parts (11) is molded into a plastic part (6).

19. The device for a fuel system according to claim 15, in which a stop (30) is provided on the plastic part (6) and the membrane unit (14, 15) can come into contact with this stop (30).

20. The device for a fuel system according to claim 19, in which the stop (30) is embodied as a valve seat.

* * * * *